US012729410B2

(12) United States Patent
Terashima et al.

(10) Patent No.: US 12,729,410 B2
(45) Date of Patent: Sep. 8, 2026

(54) POWDER FOR ANNEALING SEPARATOR AND METHOD OF PRODUCING SAME, AND METHOD OF PRODUCING GRAIN-ORIENTED ELECTRICAL STEEL SHEET

(71) Applicant: JFE STEEL CORPORATION, Tokyo (JP)

(72) Inventors: Takashi Terashima, Tokyo (JP); Karin Shiroyanagi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 183 days.

(21) Appl. No.: 18/042,299

(22) PCT Filed: Aug. 25, 2021

(86) PCT No.: PCT/JP2021/031248
§ 371 (c)(1),
(2) Date: Feb. 21, 2023

(87) PCT Pub. No.: WO2022/045221
PCT Pub. Date: Mar. 3, 2022

(65) Prior Publication Data

US 2023/0323497 A1 Oct. 12, 2023

(30) Foreign Application Priority Data

Aug. 28, 2020 (JP) ..... 2020-145035

(51) Int. Cl.
*C21D 8/1277* (2026.01)
*C21D 8/1244* (2026.01)

(52) U.S. Cl.
CPC ..... *C21D 8/1283* (2013.01); *C21D 8/1272* (2013.01); *C21D 2201/05* (2013.01)

(58) Field of Classification Search
CPC ..... C21D 8/1283; C21D 8/1272; C21D 2201/05; C21D 8/12; C21D 8/1255;
(Continued)

(56) References Cited

U.S. PATENT DOCUMENTS 4,249,966 A 2/1981 Ichida et al.
2020/0115250 A1 4/2020 Kitagaki et al.

FOREIGN PATENT DOCUMENTS

CA 1018875 A 10/1977
JP S4642703 B 12/1971
(Continued)

OTHER PUBLICATIONS

Nov. 16, 2021, International Search Report issued in the International Patent Application No. PCT/JP2021/031248.
(Continued)

*Primary Examiner* — Rebecca Janssen
*Assistant Examiner* — Mayela Aldaz
(74) *Attorney, Agent, or Firm* — KENJA IP LAW PC

(57) ABSTRACT

A powder for annealing separator that is used for a grain-oriented electrical steel sheet and enables obtainment of a grain-oriented electrical steel sheet having excellent magnetic properties as a result of favorable purification of impurities in steel. The powder for annealing separator contains magnesium oxide as a main component, and has a nitrogen gas permeability of 0.020 cm/s or more and 0.50 cm/s or less in a state of being applied between coiled steel sheets before start of secondary recrystallization.

4 Claims, 1 Drawing Sheet

(58) Field of Classification Search
CPC ..... C21D 9/46; C01P 2006/80; Y02P 10/20; C01F 5/08
See application file for complete search history.

(56) References Cited

FOREIGN PATENT DOCUMENTS

| | | | | | |
|---|---|---|---|---|---|
| JP | S49126536 | A | | 12/1974 | |
| JP | S5745472 | B2 | | 9/1982 | |
| JP | H0270020 | A | | 3/1990 | |
| JP | H059565 | A | | 1/1993 | |
| JP | H0633138 | A | * | 2/1994 | |
| JP | H11269555 | A | | 10/1999 | |
| JP | H11335742 | A | | 12/1999 | |
| JP | 2003027251 | A | | 1/2003 | |
| JP | 2004176144 | A | | 6/2004 | |
| KR | 100600805 | B1 | | 7/2006 | |
| WO | WO-2008047999 | A1 | * | 4/2008 | ..... C21D 8/1283 |

OTHER PUBLICATIONS

Jan. 29, 2024, the Extended European Search Report issued by the European Patent Office in the corresponding European Patent Application No. 21861643.1.

Jul. 15, 2025, Office Action issued by the Korean Intellectual Property Office in the corresponding Korean Patent Application No. 10-2023-7006408 with English language concise statement of relevance.

* cited by examiner

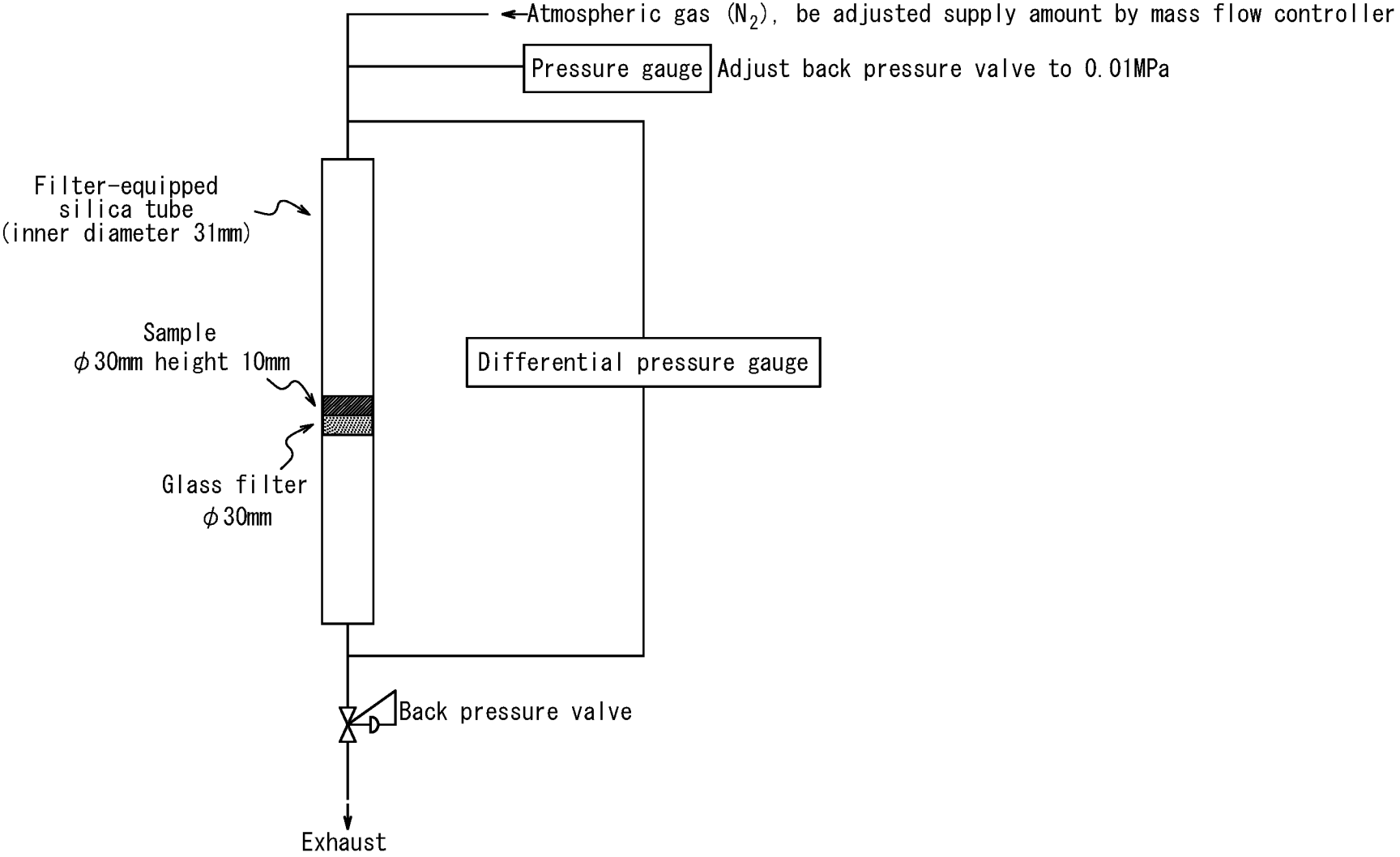
Atmospheric gas ($N_2$), be adjusted supply amount by mass flow controller
Pressure gauge
Adjust back pressure valve to 0.01MPa
Differential pressure gauge
Back pressure valve
Exhaust
Filter-equipped silica tube (inner diameter 31mm)
Sample ϕ30mm height 10mm
Glass filter ϕ30mm

POWDER FOR ANNEALING SEPARATOR AND METHOD OF PRODUCING SAME, AND METHOD OF PRODUCING GRAIN-ORIENTED ELECTRICAL STEEL SHEET

TECHNICAL FIELD

The present disclosure relates to a powder containing magnesium oxide as a main component and used as an annealing separator in production of grain-oriented electrical steel sheets. The present disclosure specifically relates to a powder for annealing separator that can solve conventional problems in coil annealing, namely, non-uniform coating appearance and insufficient removal (purification) of components to be purified (removed) from steel such as nitrogen and sulfur, which are caused by insufficient gas permeability between coil layers.

BACKGROUND

A grain-oriented electrical steel sheet is typically produced by subjecting a steel slab adjusted to a predetermined chemical composition to processes such as hot rolling, annealing, cold rolling, recrystallization annealing, and then final annealing. Typically, primary recrystallization annealing also serves as decarburization annealing, and final annealing also serves as secondary recrystallization annealing. Of these processes, the final annealing process requires treatment at a high temperature of 1200° C. or more. Hence, an annealing separator containing a magnesium oxide powder as a main component is usually applied to the steel sheet surface in order to prevent coil sticking.

Magnesium oxide not only has the foregoing role as an annealing separator, but also has a role of reacting with an oxide layer formed on the steel sheet surface during decarburization annealing and mainly made of silica to form a forsterite film, and a role of removing and purifying, from the steel sheet, precipitates (for example, part of precipitates such as AlN, MnS, MnSe, $Si_3N_4$, TiN, and TiC) called inhibitors which control the growth of iron crystal grains, during final annealing.

The forsterite film has a function as a binder that improves the adhesion between the steel sheet and a top-coated phosphate-based insulating coating, and has a function of applying tension to the steel sheet to improve the magnetic properties. Moreover, the purification of the inhibitors from the steel sheet mentioned above is important for the magnetic properties of the grain-oriented electrical steel sheet, in particular iron loss reduction.

Thus, magnesium oxide as the annealing separator has a significant role for both the coating properties and the magnetic properties of the grain-oriented electrical steel sheet.

In view of this, various efforts have conventionally been made to improve the quality of magnesium oxide (magnesia) which is a main component of annealing separators.

For example, JP S57-45472 B (PTL 1) discloses a technique of obtaining a favorable forsterite film by limiting the concentrations of impurities such as CaO, $SO_3$, and B, the specific surface area, the particle size, and the distribution of the degree of activity of citric acid to predetermined ranges.

Final annealing is typically performed in a state in which the steel sheet is coiled. There are thus problems such as degradation in the uniformity of the forsterite film and non-uniform purification of inhibitor components such as nitrogen and sulfur due to temperature deviation in the coil or non-uniform atmospheric permeability between the layers of the steel sheet.

In response to these problems, for example, JP S46-42703 B (PTL 2) proposes a method of applying magnesium hydroxide with a high coating density of 10 g/m$^2$ to 30 g/m$^2$.

JP S49-126536 A (PTL 3) proposes a technique of using, as an annealing separator, magnesia containing 1% to 20% magnesia particles of 100 mesh or more and 325 mesh or less.

CITATION LIST

Patent Literature

PTL 1: JP S57-45472 B

PTL 2: JP S46-42703 B

PTL 3: JP S49-126536 A

SUMMARY

Technical Problem

The technique described in PTL 1 is effective in obtaining a forsterite film with favorable uniformity, but has a problem in that the magnetic properties are affected by insufficient control of the amount of nitriding of the steel sheet during annealing and insufficient purification by releasing inhibitor components such as nitrogen and sulfur in the steel, which are no longer necessary after secondary recrystallization, into the atmospheric gas.

PTL 2 and PTL 3 make no reference to what kinds of measures can be taken for purifying inhibitor components. The techniques described in PTL 2 and PTL 3 therefore have a problem in that the magnetic properties may degrade due to insufficient removal of nitrogen, sulfur, and the like from steel by purification.

It could therefore be helpful to provide a powder for annealing separator that is used in production of a grain-oriented electrical steel sheet, has a high production yield rate and can be produced inexpensively by eliminating complex control factors, and enables obtainment of a grain-oriented electrical steel sheet having favorable coating uniformity and excellent magnetic properties as a result of favorable purification of impurities in steel, together with an advantageous method of producing the same.

Solution to Problem

We looked at the atmospheric permeability between the layers of a coiled steel sheet (i.e. between the coil layers), and carefully examined a technique of optimizing the atmospheric permeability to achieve favorable uniformity of a forsterite film and favorable purification of inhibitor components.

We consequently discovered the following:

1) The atmospheric permeability between the coil layers at the temperature before the start of secondary recrystallization (final annealing) influences the magnetic properties and impurity purification.
2) The atmospheric permeability after the completion of secondary recrystallization (final annealing), i.e. at an atmospheric temperature of 1000° C., influences purification by diffusion of impurities such as nitrogen and sulfur to the annealing atmosphere.

The present disclosure is based on these discoveries.

We thus provide:

1. A powder for annealing separator used as an annealing separator in production of a grain-oriented electrical steel sheet, comprising magnesium oxide as a main component, and having a nitrogen gas permeability of 0.020 cm/s or more and 0.50 cm/s or less.
2. The powder for annealing separator according to 1., containing a residue on 166 mesh sieve of 0.5 mass % or less.
3. A method of producing the powder for annealing separator according to 1. or 2., the method comprising adding magnesium oxide of 5 mass % or more and 50 mass % or less with respect to the powder for annealing separator as a whole, wherein the magnesium oxide has a degree of activity of citric acid of 300 seconds or more and contains a residue on 330 mesh sieve of 10 mass % or more and 90 mass % or less.
4. A method of producing a grain-oriented electrical steel sheet using the powder for annealing separator according to 1. or 2.

Advantageous Effect

It is thus possible to inexpensively produce a powder for annealing separator that is used as an annealing separator in production of a grain-oriented electrical steel sheet, has excellent coating reactivity, and enables obtainment of a grain-oriented electrical steel sheet from which impurities have been purified favorably.

BRIEF DESCRIPTION OF THE DRAWINGS

In the accompanying drawings:

FIG. 1 is a diagram illustrating a device for measuring nitrogen gas permeability.

DETAILED DESCRIPTION

The experiment results that led to the presently disclosed techniques will be described below.

First, samples were produced in the following manner:

As a starting material for preparing magnesium oxide, High Purity & Ultrafine Single Crystal Magnesia Powder 2000A produced by Ube Material Industries, Ltd. was used. Its purity was 99.98%.

The starting material was hydrated in pure water to obtain a magnesium hydroxide slurry. The magnesium hydroxide slurry was compressed using a filter press to obtain a magnesium hydroxide cake.

200 g of the magnesium hydroxide cake was put in an alumina crucible, placed in an electric furnace (SPX1518T-17 produced by Marusho Denki Co., Ltd.), and baked in air at a temperature of 600° C. or 1000° C. for 60 minutes after the electric furnace recuperated. The baked product was then cooled in the furnace, and ground. After the grinding, the particle size was adjusted using a sieve. The properties of the obtained magnesium oxide are shown in Table 1.

TABLE 1

| No. | Baking temperature (° C.) | Particle size residue on sieve (mass %) 500 mesh | 390 mesh | 330 mesh | 166 mesh | Degree of activity of citric acid (sec) CAA40 |
|---|---|---|---|---|---|---|
| 1-1 | 600 | 0.0 | 0.0 | 0.0 | 0.0 | 70 |
| 1-2 | 600 | 100 | 80 | 20 | 5.0 | 75 |
| 1-3 | 1000 | 100 | 2.0 | 0.1 | 0.0 | 455 |
| 1-4 | 1000 | 100 | 100 | 80 | 0.0 | 480 |
| 1-5 | 1000 | 100 | 100 | 90 | 0.0 | 486 |

The degree of activity of citric acid (CAA40) in Table 1 refers to the time (seconds) until the end of the reaction, when magnesium oxide was added to a 0.4 N citric acid solution of a temperature of 30° C. in an excess amount so that its final reaction rate would be 40% and stirred. More specifically, the degree of activity of citric acid (CAA40) can be measured under the reaction conditions that cause the final reaction rate of the magnesium oxide to be 40%, according to the method of measuring the degree of activity of citric acid described in PTL 1.

The magnesium oxide shown in Table 1 was mixed in the blending amount shown in Table 2, thus obtaining powders for annealing separator different in gas permeability.

TABLE 2

| No. | Blending amount of magnesium oxide (g) No.1-1 | No.1-2 | No.1-3 | No. 1-4 | No.1-5 | Nitrogen gas permeability (cm/s) |
|---|---|---|---|---|---|---|
| 2-1 | 100 | 0 | 0 | 0 | 0 | 0.012 |
| 2-2 | 70 | 30 | 0 | 0 | 0 | 0.020 |
| 2-3 | 70 | 0 | 30 | 0 | 0 | 0.013 |
| 2-4 | 70 | 0 | 0 | 30 | 0 | 0.32 |
| 2-5 | 70 | 0 | 0 | 0 | 30 | 0.50 |
| 2-6 | 0 | 0 | 0 | 0 | 100 | 0.70 |

In the present disclosure, the nitrogen gas permeability was measured using a device illustrated in FIG. 1 in the following manner:

4.0 g of a sample to be tested was weighed out from the obtained powder for annealing separator, and press formed into a disc having an inner diameter of 30 mm and a height of 10 mm. The formed sample was set on a glass filter (φ30 mm, pore size G1: JIS compliant) provided in a silica tube, as a test material. After setting the tube in a vertical tubular furnace, a back pressure valve was adjusted while supplying nitrogen gas so that the ventilation atmosphere would be 100% nitrogen, and the nitrogen gas flow rate (mL/min) when the atmospheric gas ($N_2$) pressure before passing the test material was 10 kPa and the atmospheric gas pressure after passing the test material was 9 kPa (that is, the differential pressure was 1 kPa) was measured. The measured nitrogen gas flow rate (mL/min) was substituted into the following formula (1) to evaluate the nitrogen gas permeability.

As mentioned above, we found out the importance of the atmospheric permeability of the powder for annealing separator in a state in which it is applied between the steel plate layers (coil layers) before the start of secondary recrystallization, and established a test method that can evaluate the atmospheric permeability of the powder for annealing separator in this state. Specifically, by forming a specified amount (4.0 g) of the sample into a specified volume (the volume of the foregoing disc of 30 mm in inner diameter and 10 mm in height) of the test material, the state in which the annealing separator prepared from the powder for annealing separator is applied between the steel sheet layers can be simulated. Furthermore, using the foregoing device in which the test material is set, the nitrogen gas permeability at room temperature (25° C.±1° C.) is measured after the atmospheric gas differential pressure between before and after passing the test material is adjusted to the specified value (1 kPa). Thus, the nitrogen gas permeability in a state in which the annealing separator is applied between the steel sheet layers before the start of secondary recrystallization is simulated. Once the annealing has started and the temperature inside the furnace has increased, there is a possibility that the gas permeability changes as a result of the progress of the sintering of the powder for annealing separator. However, the nitrogen gas permeabilities under the temperature condition (800° C. to 1000° C.) for controlling the nitriding of the steel sheet before the secondary recrystallization or under the temperature condition of 1000° C. after the completion of the secondary recrystallization can be evaluated by a nitrogen gas permeability measured at room temperature in a sample subjected to the foregoing sample pretreatment.

Therefore, the nitrogen gas permeability in the present disclosure is represented by the numerical value obtained by the above-described test.

$$\text{Permeability (cm/s)}=\text{gas flow rate (mL/min)}/(\pi\times(\varphi(30\text{ mm})/2)^2)\times 100/60 \qquad \text{formula (1).}$$

Next, a slab for an electrical steel sheet containing C: 0.045 mass %, Si: 3.25 mass %, Mn: 0.070 mass %, Al: 80 mass ppm, N: 40 mass ppm, and S: 20 mass ppm was heated to 1200° C., and then hot rolled to obtain a coil of a hot-rolled sheet of 2.0 mm in thickness. The coil of the hot-rolled sheet was subjected to hot-rolled sheet annealing at 1000° C. for 30 seconds, and then scale on the steel sheet surface was removed. Following this, the hot-rolled and annealed sheet was cold rolled using a tandem mill to obtain a cold-rolled sheet with a final cold-rolled sheet thickness of 0.23 mm. The cold-rolled sheet was then subjected to decarburization annealing (also serving as primary recrystallization annealing) of holding at a soaking temperature of 850° C. for 90 seconds. The magnesia powder shown in Table 2 was applied to the resultant cold-rolled sheet as an annealing separator, and then the cold-rolled sheet was coiled. The coil was heated to 1200° C. at a heating rate of 25° C./h in a mixed atmosphere of nitrogen: 75 vol % and hydrogen: 25 vol %, subjected to final annealing (also serving as secondary recrystallization annealing) of holding at 1200° C. for 20 hours in an atmosphere of hydrogen: 100 vol %, and then subjected to smoothing annealing to obtain a sample steel sheet.

The coating appearance uniformity, the concentrations of N and S in the steel sheet, and the repeated bending property of the sample steel sheet thus obtained were investigated.

The coating appearance uniformity was evaluated as excellent in the case where any part different in color tone was less than or equal to 1% of the total surface area by visual observation, evaluated as good in the case where any part different in color tone was less than or equal to 5% of the total surface area, evaluated as fair in the case where any part different in color tone was less than or equal to 20% of the total surface area, and evaluated as poor in the case where any part different in color tone was more than 20% of the total surface area.

The concentrations of N and S in the steel sheet were measured after removing the coating of the steel sheet by pickling. S was measured by the infrared absorption method after combustion (in accordance with JIS G 1215-4 (2018)), and N was measured by the inert gas fusion-thermal conductivity method. The repeated bending property was measured by the method in JIS C 2553 (2019), and evaluated as favorable in the case where the steel sheet was able to be bent 10 times or more.

The amount of impurities in steel was evaluated as favorable in the case where the N content was 15 mass ppm or less and the S content was 15 mass ppm or less.

Table 3 lists the magnesia powder used in the experiment and its permeability, the coating appearance uniformity, the analysis values (mass ppm) of N and S remaining in the steel sheet, and the number of bends.

As shown in Table 3, in the case where the permeability of the magnesia powder was low (No. 2-1, 2-3), the sample was inferior in all of the coating appearance uniformity, the impurity purification, and the number of bends due to insufficient impurity purification. In the case where the permeability of the magnesia powder was excessively high (No. 2-6), the coating appearance uniformity degraded.

TABLE 3

| No. | Magnesium oxide | Nitrogen gas permeability (cm/s) | Coating appearance uniformity | N (mass ppm) | S (mass ppm) | Number of bends |
|---|---|---|---|---|---|---|
| 1 | 2-1 | 0.012 | Poor | 40 | 20 | 0 |
| 2 | 2-2 | 0.020 | Good | 15 | 12 | 10 |
| 3 | 2-3 | 0.013 | Poor | 36 | 18 | 2 |
| 4 | 2-4 | 0.32 | Good | 8 | 5 | 10 |
| 5 | 2-5 | 0.50 | Good | 9 | 6 | 10 |
| 6 | 2-6 | 0.70 | Poor | 30 | 4 | 2 |

The reasons for limitation of each constituent feature in the present disclosure will be described below.

A powder for annealing separator according to the present disclosure contains magnesium oxide as a main component. The main component herein means a powder contained in an amount of 50% or more in mass %. If the content of magnesium oxide is less than 50 mass %, the formation of a forsterite film as a result of a reaction between internal silica oxide formed during decarburization annealing and magnesium oxide in the annealing separator is insufficient. Therefore, the proportion of magnesium oxide in 100 mass % of the powder for annealing separator is preferably 60 mass % or more, and more preferably 80 mass % or more. No upper limit is placed on the proportion of magnesium oxide, and the proportion of magnesium oxide may be 100 mass %.

The powder for annealing separator according to the present disclosure contains magnesium oxide as a main component. The balance other than magnesium oxide may be any powder used in conventionally known powders for annealing separator. Examples of such powders suitably used include calcium oxide, silicon oxide, magnesium phosphate, calcium phosphate, titanium oxide, boron oxide, sodium borate, magnesium hydroxide, calcium hydroxide, strontium hydroxide, aluminum hydroxide, magnesium sulfate, calcium sulfate, strontium sulfate, and aluminum sulfate. These may be used alone or in combination.

The powder for annealing separator also contains industrially inevitable impurities. Such inevitable impurities are allowed up to about 5.0 mass %.

To promote the coating appearance uniformity and the purification of inhibitor components from the steel, the nitrogen gas permeability of the powder for annealing separator according to the present disclosure in a state of being applied between the coiled steel sheets before the start of secondary recrystallization is 0.020 cm/s or more and 0.50 cm/s or less.

This is because, in order to stabilize secondary recrystallization which occurs in final annealing, it is necessary to perform annealing under environment conditions satisfying a temperature before the start of secondary recrystallization being about 800° C. and a nitrogen-containing atmosphere to appropriately increase the nitrogen content in the steel.

In detail, since the steel sheet is annealed in a coiled state, the amount of increase of nitrogen differs between the coil edge part and the coil center part, which leads to a difference in secondary recrystallization state. Accordingly, the nitrogen gas permeability of the powder for annealing separator in a state of being applied between the coiled steel sheets before the start of secondary recrystallization needs to be 0.020 cm/s or more. If the amount of increase of nitrogen is excessively large, purification by release of nitrogen from the steel into the atmosphere, which occurs at a temperature exceeding 1000° C., is insufficient, resulting in excessively large nitrogen residual amount. Accordingly, the nitrogen gas permeability of the powder for annealing separator in a state of being applied between the coiled steel sheets before the start of secondary recrystallization is 0.50 cm/s or less. From the viewpoint of appearance uniformity, the nitrogen gas permeability is preferably 0.030 cm/s or more, and more preferably 0.050 cm/s or more. The nitrogen gas permeability is preferably 0.30 cm/s or less, and more preferably 0.20 cm/s or less.

If the powder for annealing separator contains particles coarser than necessary, surface indentation flaws may occur on the steel sheet surface. Therefore, in the present disclosure, the residue on 166 mesh sieve is preferably 0.5 mass % or less, more preferably 0.4 mass % or less, and further preferably 0.3 mass % or less. The details on the method of measuring the residue on sieve will be described later.

A method of producing the powder for annealing separator according to the present disclosure is not limited, and may be in accordance with conventional methods except for those limited in the present disclosure. In particular, it is preferable to use, as a main component, magnesium oxide obtained by baking a raw material. Examples of the raw material include magnesium hydroxide, magnesium carbonate, and magnesium chloride. These may be used alone or in combination. For example, a magnesium hydroxide slurry is prepared from such raw material, and the water content of the prepared slurry is compressed using a filter press or the like to obtain a cake. The cake is baked at high temperature (approximately 950° C. to 1200° C.), and the resultant baked product is ground to obtain a magnesium oxide powder.

The simplest way of controlling the nitrogen gas permeability is to adjust the particle size distribution. Other methods involve controlling the amounts of chlorine, boron, phosphorus, etc. in magnesium oxide to obtain magnesium oxides different in sinterability and mixing these different magnesium oxide to make adjustment the nitrogen gas permeability. Alternatively, two or more of such methods may be used in combination.

The adjustment of the particle size of the powder for annealing separator in the present disclosure is not limited to being made only on the magnesium oxide which is the main component, and may be made by mixing any of the foregoing powders suitable for use as the balance, for example, compounds such as calcium oxide, calcium hydroxide, silicon oxide, magnesium phosphate, and calcium phosphate whose particle sizes are controlled beforehand.

For example, in the case of controlling the permeability by controlling the particle size distribution of magnesium oxide, magnesium oxide with a large particle size is preferably contained in order to maintain the nitrogen gas permeability after the completion of secondary recrystallization. Specifically, it is preferable that magnesium oxide containing a residue on 330 mesh sieve of 10 mass % or more and 90 mass % or less is contained in an amount of 5 mass % or more and 50 mass % or less with respect to the powder for annealing separator as a whole (i.e., 100 mass %).

Here, by reducing the degree of activity of citric acid (CAA40) of the raw material powder (magnesium oxide) (i.e. increasing the value of CAA40) and reducing the change in the particle size of the powder, a decrease in gas permeability at high temperature can be avoided. Therefore, CAA40 is preferably 300 seconds or more, more preferably 400 seconds or more, and further preferably 480 seconds or more. If CAA40 is more than 1400 seconds, the reactivity with silica at the steel sheet surface is excessively low, and the coating amount of the forsterite film decreases. Therefore, CAA40 is preferably 1400 seconds or less, more preferably 1100 seconds or less, and further preferably 950 seconds or less.

The degree of activity of citric acid (CAA40) of magnesium oxide can be controlled by adjusting the baking temperature and time depending on the raw material (magnesium carbonate, magnesium hydroxide, magnesium chloride, etc.) as appropriate during production. More specifically, the degree of activity of citric acid is higher when the baking temperature is higher and when the baking time is longer.

A steel sheet to which the presently disclosed techniques are applied is not limited to any particular steel type as long as it is for a grain-oriented electrical steel sheet having a coating mainly composed of forsterite on the surface. Such a grain-oriented electrical steel sheet is typically produced in the following manner: A silicon-containing steel slab is, by a known method, subjected to hot rolling, then to cold rolling once or a plurality of times with intermediate annealing therebetween to obtain a final thickness, and then to primary recrystallization annealing. After this, an annealing separator is applied to the resultant steel sheet, and then the steel sheet is subjected to final annealing.

If the steel sheet is thinner, the proportion of the surface contributing to the performance of the steel sheet is higher, and the influence of the atmospheric permeability is more noticeable. Thus, the magnesium oxide according to the present disclosure is more effective than the conventionally known magnesium oxide in the case of being used for a thin steel sheet of 0.23 mm or less in thickness.

EXAMPLES

First Example

Basic magnesium carbonate $(MgCO_3)_4Mg(OH)_2 \cdot xH_2O$ produced by Nacalai Tesque, Inc. was used as a starting material, and diluted with pure water to form a slurry. The slurry was then compressed using a filter press to obtain a cake. Following this, the cake was put in an alumina crucible, and baked in air in a box furnace at the temperature shown in Table 4 for 40 minutes. The baked cake was ground, and then the particle size was adjusted using a sieve to obtain raw materials 4-1 to 4-10 of powder for annealing separator. In the adjustment of the particle size, five metal JIS standard sieves (φ200 mm) of 500 mesh (opening: 25 μm), 390 mesh (opening: 38 μm), 330 mesh (opening: 45 μm), 166 mesh (opening: 90 μm), and 140 mesh (opening: 106 μm) were stacked in this order from below and set in a sieving machine (OCTAGON 200 produced by Seishin Enterprise Co., Ltd.), and 1 kg of the ground product was charged and dry-sieved for 60 minutes in the maximum vibration mode. The resultant residue on sieve was used as an index.

Moreover, magnesium chloride hexahydrate produced by Nacalai Tesque, Inc. was dissolved in pure water kept at 25° C. to prepare a saturated aqueous solution. The saturated aqueous solution was then reacted with calcium hydroxide to form magnesium hydroxide. The magnesium hydroxide thus obtained was filtered and washed with water, and then charged into pure water again to obtain a magnesium hydroxide slurry. The slurry was compressed using a filter press to obtain a cake. Following this, the cake was put in an alumina crucible, and baked in air in a box furnace at the temperature shown in Table 4 for 40 minutes. The baked cake was ground, and then the particle size was adjusted using a sieve to obtain raw materials 4-11 to 4-16 of powder for annealing separator.

The raw materials of powder for annealing separator thus adjusted were mixed as shown in Table 5 to produce powders for annealing separator varying in permeability.

TABLE 4

| | Baking temperature | Particle size residue on sieve (wt %) | | | | | Degree of activity of citric acid (sec) |
|---|---|---|---|---|---|---|---|
| No. | (° C.) | 500 mesh | 390 mesh | 330 mesh | 166 mesh | 140 mesh | CAA40 |
| 4-1 | 600 | 0.0 | 0.0 | 0.0 | 0.0 | 0.0 | 70 |
| 4-2 | 600 | 100 | 0.0 | 0.0 | 0.0 | 0.0 | 70 |
| 4-3 | 600 | 100 | 75 | 0.0 | 0.0 | 0.0 | 70 |
| 4-4 | 800 | 0.0 | 0.0 | 0.0 | 0.0 | 0.0 | 90 |
| 4-5 | 800 | 100 | 65 | 35 | 0.0 | 0.0 | 92 |
| 4-6 | 1000 | 100 | 25 | 5.0 | 0.0 | 0.0 | 480 |
| 4-7 | 1000 | 80 | 60 | 34 | 20 | 10 | 495 |
| 4-8 | 1200 | 100 | 60 | 20 | 10 | 0.0 | 866 |
| 4-9 | 1200 | 100 | 30 | 10 | 0.0 | 0.0 | 843 |
| 4-10 | 1200 | 100 | 100 | 45 | 30 | 12 | 904 |
| 4-11 | 650 | 0.0 | 0.0 | 0.0 | 0.0 | 0.0 | 66 |
| 4-12 | 950 | 100 | 25 | 5.0 | 0.0 | 0.0 | 300 |
| 4-13 | 950 | 80 | 60 | 34 | 20 | 10 | 320 |
| 4-14 | 1100 | 100 | 60 | 20 | 10 | 0.0 | 786 |
| 4-15 | 1100 | 100 | 30 | 10 | 0.0 | 0.0 | 776 |
| 4-16 | 1100 | 100 | 100 | 80 | 10 | 0.0 | 824 |

TABLE 5

| | Blending amount of magnesium oxide (g) | | | | | | | | |
|---|---|---|---|---|---|---|---|---|---|
| No. | No.4-1 | No.4-2 | No.4-3 | No.4-4 | No.4-5 | No.4-6 | No.4-7 | No.4-8 | No.4-9 |
| 5-1 | 100 | 0 | 0 | 0 | 0 | 0 | 0 | 0 | 0 |
| 5-2 | 0 | 0 | 0 | 100 | 0 | 0 | 0 | 0 | 0 |
| 5-3 | 0 | 0 | 0 | 0 | 0 | 0 | 0 | 0 | 0 |
| 5-4 | 0 | 0 | 0 | 70 | 0 | 0 | 0 | 0 | 0 |
| 5-5 | 0 | 0 | 0 | 98 | 0 | 0 | 2 | 0 | 0 |
| 5-6 | 0 | 0 | 0 | 95 | 0 | 0 | 0 | 5 | 0 |
| 5-7 | 0 | 0 | 0 | 90 | 0 | 0 | 0 | 0 | 10 |
| 5-8 | 0 | 0 | 0 | 80 | 0 | 0 | 0 | 0 | 0 |
| 5-9 | 0 | 0 | 0 | 60 | 0 | 0 | 0 | 0 | 0 |
| 5-10 | 0 | 0 | 0 | 50 | 0 | 0 | 0 | 0 | 0 |
| 5-11 | 0 | 0 | 0 | 0 | 0 | 0 | 0 | 0 | 0 |
| 5-12 | 90 | 10 | 0 | 0 | 0 | 0 | 0 | 0 | 0 |
| 5-13 | 80 | 10 | 10 | 0 | 0 | 0 | 0 | 0 | 0 |
| 5-14 | 0 | 0 | 0 | 40 | 10 | 20 | 0 | 0 | 0 |
| 5-15 | 0 | 0 | 0 | 0 | 0 | 0 | 0 | 0 | 0 |
| 5-16 | 80 | 0 | 0 | 0 | 0 | 0 | 0 | 10 | 0 |

| | Blending amount of magnesium oxide (g) | | | | | | | Nitrogen permeability (cm/s) |
|---|---|---|---|---|---|---|---|---|
| No. | No.4-10 | No.4-11 | No.4-12 | No.4-13 | No.4-14 | No.4-15 | No.4-16 | gas |
| 5-1 | 0 | 0 | 0 | 0 | 0 | 0 | 0 | 0.014 |
| 5-2 | 0 | 0 | 0 | 0 | 0 | 0 | 0 | 0.013 |
| 5-3 | 0 | 100 | 0 | 0 | 0 | 0 | 0 | 0.015 |
| 5-4 | 30 | 0 | 0 | 0 | 0 | 0 | 0 | 0.30 |

TABLE 5-continued

| | | | | | | | | |
|---|---|---|---|---|---|---|---|---|
| 5-5 | 0 | 0 | 0 | 0 | 0 | 0 | 0 | 0.020 |
| 5-6 | 0 | 0 | 0 | 0 | 0 | 0 | 0 | 0.023 |
| 5-7 | 0 | 0 | 0 | 0 | 0 | 0 | 0 | 0.025 |
| 5-8 | 20 | 0 | 0 | 0 | 0 | 0 | 0 | 0.12 |
| 5-9 | 0 | 0 | 0 | 40 | 0 | 0 | 0 | 0.27 |
| 5-10 | 0 | 0 | 0 | 0 | 0 | 50 | 0 | 0.50 |
| 5-11 | 0 | 80 | 0 | 0 | 0 | 0 | 20 | 0.26 |
| 5-12 | 0 | 0 | 0 | 0 | 0 | 0 | 0 | 0.052 |
| 5-13 | 0 | 0 | 0 | 0 | 0 | 0 | 0 | 0.027 |
| 5-14 | 0 | 0 | 10 | 0 | 20 | 0 | 0 | 0.48 |
| 5-15 | 0 | 80 | 0 | 0 | 20 | 0 | 0 | 0.22 |
| 5-16 | 0 | 0 | 0 | 10 | 0 | 0 | 0 | 0.030 |

Next, a silicon steel slab containing C: 0.06 mass %, Si: 2.95 mass %, Mn: 0.07 mass %, S: 0.015 mass %, Sb: 0.015 mass %, and Cr: 0.03 mass % with the balance consisting of Fe and inevitable impurities was heated at 1350° C. for 40 minutes, and then hot rolled to a thickness of 2.6 mm. After this, the hot-rolled sheet was subjected to hot-rolled sheet annealing at 900° C. for 60 seconds, and then cold rolled with intermediate annealing of 1050° C. and 60 seconds being interposed therebetween to obtain a final thickness of 0.23 mm, thus producing a steel sheet.

The steel sheet was subjected to decarburization annealing. After this, the powder shown in Table 5 was applied to the steel sheet as an annealing separator. The steel sheet was then heated to 1200° C. at a heating rate of 25° C./h in a mixed atmosphere of 75 vol % of nitrogen and 25 vol % of hydrogen, subjected to final annealing of holding at 1200° C. for 20 hours in an atmosphere of 100 vol % of hydrogen, and further subjected to smoothing annealing to produce a sample in this example.

The coating appearance uniformity, the surface indentation flaw length proportion (%), the concentrations of N and S in the steel sheet, and the repeated bending property of each obtained sample were investigated. The investigation results are shown in Table 6.

The coating appearance uniformity was evaluated as excellent in the case where any part different in color tone was less than or equal to 1% of the total surface area by visual observation, evaluated as good in the case where any part different in color tone was less than or equal to 5% of the total surface area, evaluated as fair in the case where any part different in color tone was less than or equal to 20% of the total surface area, and evaluated as poor in the case where any part different in color tone was more than 20% of the total surface area.

A surface indentation flaw length proportion (surface indentation flaw occurrence rate) of 5.0% or less is favorable, and a surface indentation flaw length proportion (surface indentation flaw occurrence rate) of 1.0% or less is particularly favorable. As the surface indentation flaw occurrence rate, the length of a part having two or more surface indentation flaws per 1 $m^2$ of the steel sheet was measured in the rolling direction, and expressed as the length ratio to the total length of the steel sheet coil.

The concentrations of N and S in the steel sheet were measured after removing the coating of the steel sheet by pickling. S was measured by the infrared absorption method after combustion, and N was measured by the inert gas fusion-thermal conductivity method.

The repeated bending property was measured by the method in JIS C 2553 (2019), and evaluated as favorable in the case where the steel sheet was able to be bent 10 times or more.

TABLE 6

| No. | Magnesium oxide | Nitrogen gas permeability (cm/s) | Residue on 166 mesh sieve (mass %) | Coating appearance uniformity | Surface indentation flaw (occurrence rate %) | N (mass ppm) | S (mass ppm) | Number of bends | Remarks |
|---|---|---|---|---|---|---|---|---|---|
| 1 | 5-1 | 0.014 | 0.0 | Poor | 0.0 | 40 | 15 | 0 | Comparative Example |
| 2 | 5-2 | 0.013 | 0.0 | Poor | 0.0 | 35 | 15 | 3 | Comparative Example |
| 3 | 5-3 | 0.015 | 0.0 | Poor | 0.0 | 36 | 15 | 2 | Comparative Example |
| 4 | 5-4 | 0.30 | 9.0 | Excellent | 4.5 | 7 | 4 | 10 | Example |
| 5 | 5-5 | 0.020 | 0.4 | Good | 0.8 | 10 | 8 | 10 | Example |
| 6 | 5-6 | 0.023 | 0.5 | Good | 1.0 | 11 | 9 | 10 | Example |
| 7 | 5-7 | 0.025 | 0.0 | Good | 0.0 | 13 | 8 | 10 | Example |
| 8 | 5-8 | 0.12 | 6.0 | Excellent | 3.8 | 12 | 7 | 10 | Example |
| 9 | 5-9 | 0.27 | 8.0 | Excellent | 4.0 | 8 | 4 | 10 | Example |
| 10 | 5-10 | 0.50 | 0.0 | Good | 0.0 | 15 | 4 | 10 | Example |
| 11 | 5-11 | 0.26 | 2.0 | Excellent | 2.8 | 6 | 4 | 10 | Example |
| 12 | 5-12 | 0.052 | 0.0 | Excellent | 0.0 | 11 | 8 | 10 | Example |
| 13 | 5-13 | 0.027 | 0.0 | Good | 0.0 | 15 | 8 | 10 | Example |
| 14 | 5-14 | 0.48 | 2.0 | Good | 2.8 | 13 | 4 | 10 | Example |
| 15 | 5-15 | 0.22 | 2.0 | Excellent | 2.6 | 11 | 5 | 10 | Example |
| 16 | 5-16 | 0.030 | 3.0 | Excellent | 2.3 | 8 | 4 | 10 | Example |

As shown in Table 6, in the case where the permeability of the annealing separator was low (No. 5-1, 5-2, 5-3), the sample was inferior in the coating appearance uniformity, the impurity purification, and the number of bends due to insufficient impurity purification. In the case where the annealing separator had the desired nitrogen gas permeability, the sample was superior in all of the coating appearance uniformity, the impurity purification, and the repeated bending property. Particularly in the case where the residue on sieve (166 mesh) was 0.5 mass % or less, a very favorable result with a surface indentation flaw occurrence rate of 1.0% or less was achieved.

Second Example

The magnesium oxide of No. 1-1 in Table 1 was mixed with calcium oxide (average particle size: 45 μm), silicon oxide (average particle size: 60 μm), and/or magnesium phosphate (average particle size: 53 μm) different in particle size in the proportion shown in Table 7, thus preparing a powder for annealing separator containing magnesium oxide with the permeability shown in Table 7.

Next, a slab for an electrical steel sheet containing C: 0.045 mass %, Si: 3.25 mass %, Mn: 0.070 mass %, Al: 120 mass ppm, N: 50 mass ppm, and S: 40 mass ppm was heated to 1200° C., and then hot rolled to obtain a coil of a hot-rolled sheet of 2.0 mm in thickness. The hot-rolled sheet was subjected to hot-rolled sheet annealing at 1000° C. for 30 seconds, and scale on the steel sheet surface was removed. The hot-rolled sheet was then cold rolled by a tandem mill to produce a steel sheet with a final cold-rolled sheet thickness of 0.20 mm.

The steel sheet was subjected to decarburization annealing of holding at a soaking temperature of 850° C. for 90 seconds. A mixture of 100 g of the powder (No. 1 to 11) shown in Table 7 and 5.0 g of titanium oxide was applied to the steel sheet as an annealing separator, and the steel sheet was coiled. The steel sheet was then heated to 1200° C. at a heating rate of 25° C./h in a mixed atmosphere of 75 vol % of nitrogen and 25 vol % of hydrogen, subjected to final annealing of holding at 1200° C. for 20 hours in an atmosphere of 100 vol % of hydrogen, and further subjected to smoothing annealing to produce a sample in this example.

The coating appearance uniformity, the surface indentation flaw length proportion (%), the concentrations of N and S in the steel sheet, and the repeated bending property of each obtained sample were investigated. The investigation results are shown in Table 7.

The coating appearance uniformity was evaluated as excellent in the case where any part different in color tone was less than or equal to 1% of the total surface area by visual observation, evaluated as good in the case where any part different in color tone was less than or equal to 5% of the total surface area, evaluated as fair in the case where any part different in color tone was less than or equal to 20% of the total surface area, and evaluated as poor in the case where any part different in color tone was more than 20% of the total surface area.

A surface indentation flaw length proportion of 5.0% or less is favorable, and a surface indentation flaw length proportion of 1.0% or less is particularly favorable.

The concentrations of N and S in the steel sheet were measured after removing the coating of the steel sheet by pickling. S was measured by the infrared absorption method after combustion, and N was measured by the inert gas fusion-thermal conductivity method.

The repeated bending property was measured by the method in JIS C 2553 (2019), and evaluated as favorable in the case where the steel sheet was able to be bent 10 times or more.

TABLE 7

| No. | Magnesium oxide (No.1-1) (g) | Calcium oxide (g) | Silicon oxide (g) | Magnesium phosphate (g) | Nitrogen gas permeability (cm/s) | Residue on 166 mesh sieve (mass %) | Coating appearance uniformity | Surface indentation flaw (occurrence rate %) | N (mass ppm) | S (mass ppm) | Number of bends | Remarks |
|---|---|---|---|---|---|---|---|---|---|---|---|---|
| 1 | 100 | 0 | 0 | 0 | 0.012 | 0.0 | Poor | 0.0 | 45 | 38 | 0 | Comparative Example |
| 2 | 98 | 2 | 0 | 0 | 0.020 | 0.1 | Good | 0.7 | 15 | 10 | 10 | Example |
| 3 | 95 | 5 | 0 | 0 | 0.025 | 0.3 | Good | 0.8 | 12 | 9 | 10 | Example |
| 4 | 90 | 10 | 0 | 0 | 0.070 | 0.5 | Excellent | 1.0 | 7 | 4 | 10 | Example |
| 5 | 95 | 0 | 5 | 0 | 0.050 | 0.4 | Excellent | 0.8 | 8 | 6 | 10 | Example |
| 6 | 85 | 0 | 15 | 0 | 0.18 | 1.2 | Excellent | 2.0 | 4 | 8 | 10 | Example |
| 7 | 90 | 0 | 0 | 10 | 0.12 | 0.6 | Excellent | 1.6 | 4 | 7 | 10 | Example |
| 8 | 80 | 0 | 0 | 20 | 0.30 | 1.2 | Excellent | 2.2 | 3 | 4 | 10 | Example |
| 9 | 50 | 40 | 0 | 10 | 0.36 | 2.6 | Good | 3.2 | 4 | 4 | 10 | Example |
| 10 | 40 | 50 | 10 | 0 | 0.80 | 3.3 | Poor | 4.1 | 34 | 4 | 2 | Comparative Example |
| 11 | 40 | 40 | 10 | 10 | 0.88 | 3.4 | Poor | 4.3 | 40 | 4 | 0 | Comparative Example |

As shown in Table 7, in the case where the permeability of the annealing separator was low (No. 1), the sample was inferior in the coating appearance uniformity, the impurity purification, and the number of bends due to insufficient impurity purification. In the case where the amount of magnesium oxide used was 40 g (i.e. the ratio in the annealing separator was 40 mass %, No. 10, 11), the nitrogen gas permeability of the annealing separator could not be controlled to the desired range according to the present disclosure and the purification of N was insufficient, so that the sample was inferior in the coating appearance uniformity and the repeated bending property. In the case where the annealing separator had the desired permeability, the sample was superior in all of the coating appearance uniformity, the impurity purification, and the repeated bending property. Particularly in the case where the residue on sieve (166 mesh) was 0.5 mass % or less, a very favorable result with a surface indentation flaw occurrence rate of 1.0% or less was achieved.

The invention claimed is:

1. A powder for annealing separator used as an annealing separator in production of a grain-oriented electrical steel sheet, comprising magnesium oxide in an amount of 50 mass % to 90 mass %, and having a nitrogen gas permeability of 0.020 cm/s or more and 0.50 cm/s or less, wherein the magnesium oxide has a degree of activity of citric acid of 300 seconds or more and 1400 seconds or less.

2. The powder for annealing separator according to claim 1, containing a residue on 166 mesh sieve of 0.5 mass % or less.

3. A powder for annealing separator used as an annealing separator in production of a grain-oriented electrical steel sheet, comprising magnesium oxide in an amount of 50 mass % to 85 mass %, and having a nitrogen gas permeability of 0.020 cm/s or more and 0.50 cm/s or less.

4. The powder for annealing separator according to claim 3, containing a residue on 166 mesh sieve of 0.5 mass % or less.

* * * * *